US006415951B2

(12) United States Patent
Dessing et al.

(10) Patent No.: US 6,415,951 B2
(45) Date of Patent: Jul. 9, 2002

(54) DEVICE AND METHOD FOR SELLING FOODSTUFFS

(75) Inventors: Jacobus Petrus Maria Dessing, La Cruquius; Mattijn Godewijn DeGraaf, Leiden; Pieter Adriaan Oosterling, Nieuw-Vennep, all of (NL)

(73) Assignee: Foodcorner International B.V., Beuningen (NL)

( * ) Notice: Subject to any disclaimer, the term of this patent is extended or adjusted under 35 U.S.C. 154(b) by 0 days.

(21) Appl. No.: 09/766,706

(22) Filed: Jan. 22, 2001

Related U.S. Application Data

(63) Continuation of application No. PCT/NL99/00443, filed on Jul. 7, 1999.

(30) Foreign Application Priority Data

Jul. 22, 1998 (NL) ..... 1009715

(51) Int. Cl.[7] ..... A47F 1/00
(52) U.S. Cl. ..... 221/100; 221/150 R
(58) Field of Search ..... 221/150 R, 120 HC, 221/150 A, 92, 98, 100, 99, 7, 9, 13, 131, 191, 247, 266, 281

(56) References Cited

U.S. PATENT DOCUMENTS

| | | | | |
|---|---|---|---|---|
| 4,823,984 A | * | 4/1989 | Ficken | 221/96 |
| 5,025,950 A | | 6/1991 | Trouteaud et al. | 221/5 |
| 5,097,986 A | | 3/1992 | Domberg et al. | 221/150 |
| 5,247,798 A | * | 9/1993 | Collard, Jr. | 221/266 |
| 5,499,707 A | | 3/1996 | Steury | 194/217 |

FOREIGN PATENT DOCUMENTS

| | | |
|---|---|---|
| DE | 34 12 900 | 10/1985 |
| DE | 196 50 394 | 6/1998 |

* cited by examiner

*Primary Examiner*—Kenneth W. Noland
(74) *Attorney, Agent, or Firm*—St. Onge Steward Johnston & Reens LLC

(57) ABSTRACT

This invention relates to a device for selling foodstuffs. Product carriers are stored on a storage rack in a cabinet with a cooled atmosphere. A stock of foodstuff, such as meat products, is present on the product carriers. An ordered quantity is separated from this foodstuff by separating means, such as a cutting machine, and is then packaged. The invention relates to the removal of product carriers from the cabinet and the introduction of product carriers into the cabinet, by making use of a filling station.

10 Claims, 1 Drawing Sheet

DEVICE AND METHOD FOR SELLING FOODSTUFFS

Figure 1:
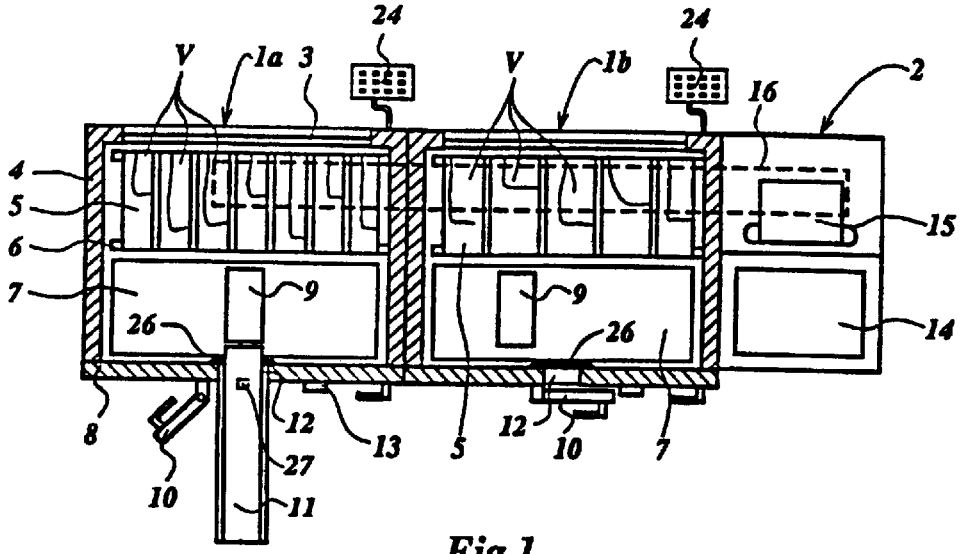

This is a continuation of pending International Application PCT/NL99/00433 filed on Jul. 7, 1999, which designated the United States.

The invention relates to a device according to the preamble of claim 1. A device of this nature is known from U.S. Pat. No. 5,520,941. The drawback of the known device is that it is necessary to stop dispensing foodstuffs when the device is being stocked up. This is because stocking up involves taking empty product carriers out of the storage rack and replacing them with product carriers which are filled with foodstuff. In doing so, the cabinet has to be opened, so that the interior of the cabinet is accessible. During this time, the conveyor means are stopped and blocked, since otherwise the operator can come into contact with the moving conveyor means, resulting in the possibility of injury. While the conveyor means are at a standstill and the cabinet is open, the device cannot be used, which is undesirable. In order to prevent this drawback, the device is designed according to the characterizing part of claim 1 (application claim 12). Since the cabinet remains closed, the conveyor means can continue to function more or less without interference in any situation while exchanging empty product carriers and filled product carriers.

According to a refinement, the device is designed according to claim 2 (application claim 13). As a result of only a small part of the wall being opened when filing the cabinet, the cooled atmosphere in the cabinet is not lost, resulting in a considerable energy saving and limiting condensation.

According to a further refinement, the device is designed according to claim 3 (application claim 14). By making the opening no larger than the smallest dimensions of a product carrier, it is possible to introduce the product carrier with the foodstuff into the cabinet while scarcely any cooled air escapes.

According to one embodiment of the invention, it is designed according to claim 4 (application claim 15). The possibility of blocking the introduction of a filled product carrier prevents a fault from occurring if there is a failure to satisfy all the conditions required for introduction, such as imputing of the correct data and the correct position of the conveyor means.

According to one embodiment of the invention, it is designed according to claim 5 (application claim 16). This makes it possible to prevent the conveyor means from colliding with an object which has been inserted into the cabinet, such as for example a hand or arm, thus preventing injury.

According to one embodiment of the invention, it is designed according to claim 6 (application claim 17). In this way, it is easily possible to transmit the data of a product carrier to the control system, avoiding errors.

According to one embodiment of the invention, it is designed according to claim 7 (application claim 18). By providing the separating means with a buffer, it is possible for the separating means to operate without interruption and without having to wait for the supply or removal of the products carriers by the conveyor means. It is also possible for the conveyor means to supply and take away product carriers while the separating means are busy with one product carrier. This makes the device more efficient in use.

According to one embodiment of the invention, it is designed according to claim 8 (application claim 19). In this way, it is possible, at the same time, to maintain a low temperature in the cabinet, which is beneficial for the cutting properties of the foodstuff, and a high relative humidity, preventing the stored foodstuff from drying out.

The invention also comprises a method for stocking up a device according to the invention, as described in claim 9 (application claim 21). By using the conveyor device in the cabinet for taking the product carriers out of the cabinet, it is possible to achieve a rapid and efficient method.

According to a further refinement of the method, it is carried out according to claim 11 (application claim 22). By providing the control unit with information relating to the introduced product carrier and the foodstuff during the introduction of a product carrier, errors relating to the characteristics of the articles present in the device are eliminated as far as possible.

According to a further refinement of the method, it is carried out according to claim 11. By providing the control unit with information relating to the introduced product carrier and the foodstuff during the introduction of a product carrier, errors relating to the characteristics of the articles present in the device are eliminated as far as possible.

Figure 2:
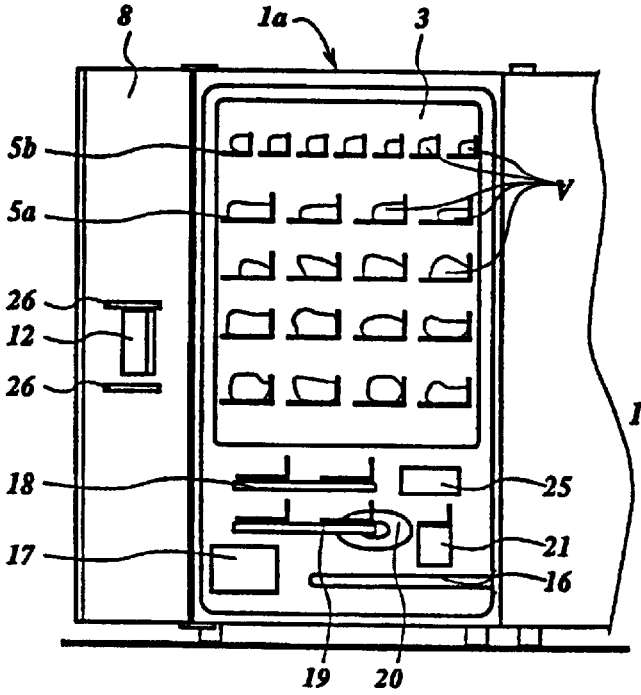
Figure 3:
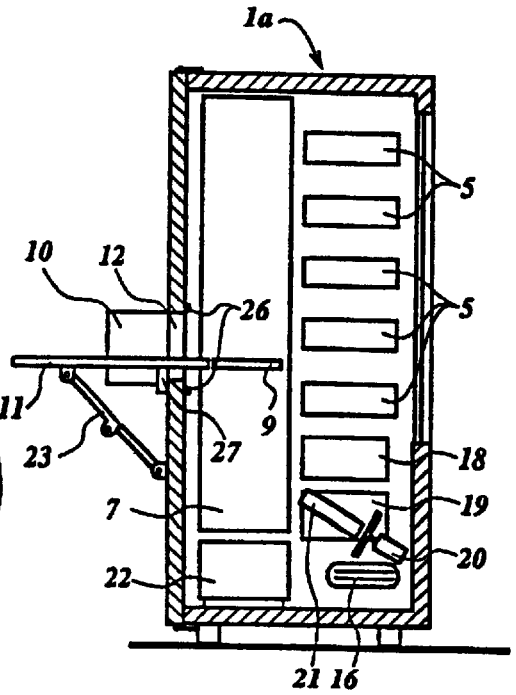

The invention is illustrated below with reference to a number of exemplary embodiments and with the aid of a drawing, in which:

FIG. 1 shows a diagrammatic plan view of a cabinet for dispensing foodstuff, such as meat products, FIG. 2 shows the rear view, with the door open, of the cabinet shown in FIG. 1, and FIG. 3 shows a diagrammatic cross section through the cabinet shown in FIG. 1.

The figures provide a diagrammatic representation of the most important components, which may be realized in a wide variety of manners by the person skilled in the art. Details such as pipes, attachment means, hinges and the like are indicated purely incidentally.

FIG. 1 shows a device for dispensing meat products as is known from U.S. Pat. No. 5,520,941. A cabinet 1*a* has insulating walls 4, an insulting door 8 and an insulating window 3. The top side and underside of the cabinet are also insulated, and all further necessary measures are taken, so that a temperature of approximately −2° C. can be maintained in the cabinet. The internal walls of the cabinet and floor are of smooth design, so that they are easy to clean when the equipment has been removed from the cabinet.

A storage rack 6 is disposed in the cabinet 1*a*. Product carriers 5 are located next to and above one another in the storage rack 6, in such a manner that the foodstuff V which is attached to the product carriers 5 can be seen through the window 3. A conveyor device 7 is positioned parallel to the storage rack 6, with a carriage 9 by means of which the product carriers 5 can be taken out of the storage rack 6 and can be conveyed to a cutting device 20 (cf. in this respect the description associated with FIG. 2). Under the influence of a control unit 17 (cf. FIG. 2), the carriage 9 moves between the various positions in the cabinet 1*a*. Foodstuff V which is to be cut off, such as for example meat products, is positioned on the product carriers 5.

The door 8 of the cabinet 1*a* is provided with an opening 12 which can be closed off by means of an insulating hatch 10. An introduction carriage 11 may be arranged on the door 8 at the location of the opening 12, with the aid of which carriage product carriers 5 can be taken from the carriage 9 and, when they have been filled, placed back on the carriage 9. The introduction carriage 11 is provided with a blocking means 27, which is coupled to the control unit 17. In order to transmit the data of a product carrier 5 which is to be introduced and of the foodstuff V located thereon, or in particular the meat products, to the control units 17, a keyboard 13 is arranged next to the opening 12. A detector 26 for detecting objects which are inserted through the opening 12 into the cabinet and therefore into the path of the conveyor device 7 is arranged on the inside of the door 8, in the vicinity of the opening 12. If objects are detected, the control unit 17 is notified of this and the conveyor device 7 is stopped. The detector 26 may be designed as a light screen, or possibly as a door with a switch.

In the device shown in FIG. 1, two more or less identical cabinets 1*a* and 1*b* are shown, with a dispensing station 2 next to them. A person wishing to order foodstuff V gives his/her order to the control unit 17 via a control panel 24. Then, the foodstuff V, such as for example meat products, is cut off, for example in the cabinet 1*a,* and is conveyed to the dispensing station 2 via a conveyor belt 16. The meat products are then packaged in a packaging unit 14 and are delivered to the user via a dispensing chute 15.

FIG. 2 shows the rear side of the cabinet 1*a,* with the door 8 open and the conveyor device 7 removed. This is easy, since the latter is on wheels. It is possible to see the product carriers 5 which lie in storage racks 6 (not indicated) with the foodstuff V thereon. Narrow product carriers 5*b* are located in the top of the cabinet, and wide product carriers 5*a* are located in the bottom of the cabinet.

The cutting device 20 is positioned beneath the storage rack 6 with the product carriers 5, and is shown holding a product carrier 5 which has been moved into a cutting position 21. In connection with cleaning work, it is necessary for it to be possible to take the cutting device 20 out of the cabinet, and to this end the cutting device is on wheels. In order to enable the conveyor device 7 to supply or take away product carriers 5 during the cutting operation, the cutting device 20 is provided with an introduction buffer 18 with one or two storage positions for product carriers 5, a removal buffer 19, likewise with one or two positions for the product carrier 5, and a manipulator 25 for putting the product carriers 5 into the cutting device 20 or removing them therefrom. The conveyor device 7 places a product carrier 5 into the introduction buffer 18, and then this product carrier is placed into the cutting device 20 by the manipulator 25, and the desired quantity of foodstuff V is cut off. Then, the product carrier 5 is placed into the removal buffer 19 by the manipulator 25. The conveyor device 7 moves the product carrier 5 out of the removal buffer 19 to its storage position or, in the event of a repeat order, back into the introduction buffer 18. The foodstuff which has been cut off is conveyed to the dispensing station 2 by the conveyor belt 16.

In another embodiment, the introduction buffer 18 and the removal buffer 19 may also be combined to form, for example, a paternoster, by means of which the product carriers 5 are conveyed in steps towards and away from cutting position 21 and are placed in the cutting position, for example by the manipulator 25.

FIG. 3 shows a cross-sectional view through the cabinet 1*a,* with the carriage 9 of the conveyor device 7 located in front of the introduction carriage 11, so that a product carrier 5 can be introduced. The introduction carriage 11 is supported by a support 23. A cooling unit 22, with which the temperature in the cabinet can be kept at approximately −2° C., is diagrammatically depicted beneath the conveyor device 7. In order to allow the interior of the cabinet 1*a* to be cleaned, the cooling unit 22 is on wheels. If appropriate, the cooling unit is provided with a fan and with means for removing or preventing frost. Since, during normal use of the device, the door 8 can remain closed, as the foodstuff V is introduced via the small opening 12, it is possible for the capacity of the cooling unit 22 to be limited. Since a low temperature −2° C. is maintained in the cabinet 1 with a high atmospheric humidity, the temperature difference between the cooling surface of the cooler 22 and the cabinet must be limited to a few degrees Celsius. The cooling surface of the cooler 22 must therefore be very large and is at least 1.5 times to twice the size of the surface of the walls of the cabinet.

The device is preferably filled during normal operation. After the hatch 10 has been opened and the introduction carriage 11 has been positioned in front of the opening 12, the operator calls up a product carrier 5 which is to be filled by inputting a command to the control unit 17. The carriage 9 then positions an empty product carrier 5 in front of the introduction carriage 11, under the influence of the control unit 17. The operator removes this product carrier 5 from the cabinet 1*a,* if appropriate using a special removal tool, after which the conveyor device 7, following this brief interruption, can again operate normally, and the dispensing of foodstuff V can continue without interruption.

After the operator has filled the product carrier 5, the latter is placed on the introduction carriage 11. The introduction carriage 11 is provided with a blocking means 27 which is operated by the control unit 17, so that the product carrier 5 cannot be pushed into the cabinet if the conveyor device 7 is not ready and, for example, the carriage 9 is at the correct position. Then, the keyboard 13 is used to input which foodstuff V has been placed on the product carrier 5, and also, for example, its price and any other relevant information. The width of the product carrier 5 is also input, so that it is possible to monitor whether a storage position for this width is still free in the cabinet. After this data has been processed in the control unit 17, the conveyor device 7 is activated. After the carriage 9 has moved to the correct position, the introduction blocking is eliminated and the product carrier 5 can be introduced into the cabinet 1*a*. In the process, the width of the product carrier is also checked, in order to ensure that the data were input correctly and in order to prevent faults.

Numerous alternative designs are possible in addition to the design described above.

In the design shown, the introduction carriage 11 is arranged on the rear side of the cabinets 1*a* and 1*b,* with the conveyor device 7 positioned between the introduction carriage 11 and the storage rack 6. However, it is also possible to arrange the introduction carriage 11 on the front side and, for example, to allow it to form part of the storage rack 6. In this case, an opening is made on the front side of the cabinet for introduction and removal of the product carriers 5, the latter being pushed directly into the introduction carriage in the storage rack 6.

An alternative design involves integrating the hatch 10, the introduction carriage 11 and the support 23, so that the hatch 10 is at the same time the support for the introduction of product carriers and, for example, the hinges are arranged on the underside of the hatch 10.

A cutting device 20 is incorporated in the exemplary embodiment described above. In a situation in which, for example, meal components, such as vegetables and salads and the like are stored in a cabinet 1, different separating means will be arranged in the cabinet instead of a cutting device 20. In this case, for example, a plastic tray, which is supplied with suitable means, is filled by means of an automatic scoop device.

The cooling unit 22 described above, which is positioned in the bottom of the cabinet as a separate module, may also be positioned on the cabinet. It is also possible, for example, to design the walls as cooling plates, and if appropriate flash evaporators may also be used, or else the cooling system may be arranged in the top of the cabinet. In addition to cooling, it is also possible to provide other measures in order to obtain a suitable atmosphere in the cabinet 1. Consideration must be given to means for controlling the humidity or means for supplying special gases, such as carbon dioxide, alcohol vapours and the like.

The control unit 17 is shown as a module in the bottom of the cabinet 1*a*. However, it is also possible to accommodate the control unit in a separate switch box which is connected to the various components of the device by means of cables. The control unit interacts, in a known way, with the sensors, motors, encoders and the like which are present in the cabinets 1*a*, 1*b* and 2 in order to correctly execute the orders input on the control panels and all further operations which are required for maintenance of the device, such as for example the above-described operation of filling the device.

In addition to the above-described configuration with two cabinets and one dispensing station, it is, of course, also possible to use other configurations, depending on the conditions which prevail in the shop area.

What is claimed is:

1. A device for selling foodstuffs comprising:

a cabinet having heat insulating-walls one of which is provided with a door; a storage rack in the cabinet for storing a variety of product carriers, each of which is filled with a foodstuff;

a cooling unit in the cabinet for keeping the cabinet's interior at a storage temperature;

a conveyor for transporting the product carriers along a path from and to the storage rack;

a separator spaced from the storage rack along the path for separating a quantity of the foodstuffs upon delivery of the product carrier:

a filling station located along the path for removing the product carries to be reloaded with foodstuffs and for reintroducing the refilled product carriers; and a controller for selectively delivering product carriers to the separator in response to a customer's request and to the filling station, said filling station having a closable opening sized to allow the product carrier to be displaced from and into the interior of the cabinet while keeping the door closed.

2. The device defined in claim 1 wherein the conveyor has a first carriage displaceable with the conveyor and receiving the product carrier for transporting it between a loading position, wherein the first carriage is positioned in alignment with the opening of the filling station, the separator and a predetermined position on the storage rack.

3. The device defined in claim 2 wherein the filling station is provided with an introduction carriage displaceable into the opening to cooperate with the first carriage for displacing the transported product carrier from and into the interior of the cabinet, the introduction carriage being provided with a blocker operatively connected to the controller which generates a signal actuating the blocker to prevent the displacement of the product carrier if the first carriage is not placed in the loading position after the conveyor has been stopped.

4. The device defined in claim 2 wherein the filling station is provided with a detector generating a signal, which is received by controller, in response to insertion of the introduction carrier into the opening, the controller generating a stop signal in response the signal from the detector to arrest the displacement of the conveyor in a position corresponding to the loading position of the first carriage.

5. The device defined in claim 2 wherein the loading station is provided with a data input device for inputting a name of a foodstuff filling the product carrier ready to be introduced in the interior of the cabinet, a price of the foodstuff, and a width of the product carrier to inquire if the storage rack has an available space for the inputted size of the product carrier.

6. The device defined in claim 1 wherein the separator includes a cutter, an introduction buffer for storing the product carrier delivered to the separator by the conveyor, a removal buffer, and a manipulator for displacing the product carrier with foodstuff from the introduction buffer to the cutter and for further displacement of the food carrier to the removal buffer to advance the product carrier back to the conveyor after necessary quantity of the foodstuff has been cut.

7. The device defined in claim 1 wherein the cabinet has front, back and side walls, the loading station being located in the wall selected from the group consisting of the front and back walls.

8. The device defined in claim 1 wherein the cooling unit has a cooling surface which is 1.5 to twice as large as the surface of the insulating walls of the cabinet.

9. A method of operating a device for selling foodstuffs comprising the steps of:

providing a closable opening in a door of a cabinet containing a plurality of product carriers which are filled with the foodstuffs and sizing said opening to be substantially the same as the size of the product carrier;

delivering the product carrier toward the closable opening in a loading position to refill this product carrier with a foodstuff; and removing the product carrier from an interior of the cabinet without opening the door displacing an introduction carriage into the opening, thereby generating a signal indicative of this displacement;

arresting displacement of a delivery conveyor transporting product carriers between a storage rack in response to the signal, the delivery opening and a foodstuff separator, thereby positioning a transport carriage provided on the delivery conveyor in alignment with the opening in a loading position;

displacing the food carrier from and back into the interior of the cabinet.

10. The method defied in claim 8 further comprising the steps of inputting a name of a foodstuff filling the product carrier ready to be introduced into the interior of the cabinet, a price of the foodstuff, and a width of the product carrier to inquire if the storage rack has an available space for the inputted size of the product carrier, monitoring the loading position, and introducing the product carrier onto the transport carriage if it is positioned in the loading position.

* * * * *